United States Patent [19]

Hosie

[11] Patent Number: 4,484,709

[45] Date of Patent: Nov. 27, 1984

[54] SPRINKLER DEFLECTOR

[75] Inventor: William C. Hosie, Linden, Calif.

[73] Assignee: William C. Hosie, Inc., Linden, Calif.

[21] Appl. No.: 339,366

[22] Filed: Jan. 15, 1982

[51] Int. Cl.[3] ..... B05B 1/26

[52] U.S. Cl. ..... 239/231; 239/230; 239/513

[58] Field of Search ..... 239/231, 232, 519, 498, 239/502, 513, 515, 517, 522, 524

[56] References Cited

U.S. PATENT DOCUMENTS

| | | | |
|---|---|---|---|
| 440,159 | 11/1890 | Hoyt | 239/498 X |
| 2,228,720 | 1/1941 | Coles et al. | 239/231 X |
| 3,703,993 | 11/1972 | Schreiner | 239/231 |
| 4,376,513 | 3/1983 | Hagar | 239/231 |

OTHER PUBLICATIONS

Advertisement for "Stream Splitter", manufactured by Rain Bird.

*Primary Examiner*—John J. Love
*Attorney, Agent, or Firm*—Townsend and Townsend

[57] ABSTRACT

A sprinkler deflector including a generally flat, elongate base and upwardly and outwardly V-shaped deflector arms is mounted between a sprinkler head and a riser via a hole in the elongate base. The V-shaped deflector arms deflect water from the sprinkler head upwardly and outwardly to provide unwatered areas about the edge of an otherwise circular watered area. The unwatered areas are positioned to coincide with the tree trunks in an orchard. The width and the depth or minimum radius of each unwatered area is changed by changing the angle at which the deflector arm extends from the base.

7 Claims, 4 Drawing Figures

SPRINKLER DEFLECTOR

BACKGROUND OF THE INVENTION

Orchards are often watered using above ground sprinklers. The sprinklers are typically of the impact type and produce a circular watering pattern. In order to ensure that most of the ground in an orchard is watered, the watering patterns of the sprinklers often overlap and wet the trunks of the trees. It has been found desirable to water orchards at relatively low rates for extended periods of time to keep the surface from becoming saturated. However such watering keeps the trunks of the trees wet for long periods so that mold and other harmful infestations of the bark of the tree can result.

In order to keep tree trunks dry a sprinkler flow diverter called a Stream Splitter made by Rainbird of Glendora, Calif. has been introduced. This device includes a pair of upwardly extending generally flat arms, the ends of which are apparently bent to produce the unwatered areas. It is mounted to the riser supporting the sprinkler head by a U-bolt. Mounting the devices can be a rather awkward and time consuming procedure, a definite disadvantage when one considers the great number of sprinkler heads in an orchard. Further, such a device does not appear to be easily adaptable for protecting more than two trees.

Another type of prior art sprinkler deflector is shown in U.S. Pat. No. 3,703,993. This type of sprinkler deflector includes a hat like deflector member mounted above the sprinkler head. Numerous flat radial fingers are bent downwardly to vary the shape of the watered area. Although such a sprinkler deflector apparently can produce complex watering patterns, the water is deflected downwardly so that overwatering near the sprinkler head can result.

Although the problem of allowing tree trunks to remain wet for extended periods of time has been recognized and attempts have been made to solve the problem, available sprinkler deflectors have shortcomings which make them less than ideal for solving the problem of keeping the tree trunks dry.

SUMMARY OF THE INVENTION

A sprinkler deflector including a generally flat, elongate base having a central mounting hole and upwardly and outwardly V-shaped deflector arms is mounted between a sprinkler head and a riser. The sprinkler deflector is preferably a unitary piece and is made from a deformable material, such as aluminum or galvanized iron. The V-shaped deflector arms cause the watering pattern produced by an impact type sprinkler to be generally circular with unwatered areas, corresponding to each deflector arm, resembling notches in the circumference of the circular watered area.

The notched unwatered areas are positioned to coincide with three trunks in an orchard. The width of each unwatered area and the depth or minimum radius of each unwatered area is changed by varying the angle at which the deflector arm extends from the base.

Typically two sprinkler deflectors are mounted at each sprinkler to accommodate four trees, which are usually arranged in a rectangular pattern. Dimples can be made in the base surrounding the mounting hole. The dimples act as a resilient lock washer between the sprinkler head and the riser. Since risers are often made of plastic, the dimples deform the plastic somewhat to keep the sprinkler deflectors from shifting position. The dimpled feature can be used to ensure that a pair of sprinkler deflectors mounted to a sprinkler remain perpendicular to one another by the alignment of the dimples in one with the dimple depressions of the other. The dimples also act as spacers between the sprinkler head and the riser.

The apparatus of the present invention allows the user to provide one or more unwatered areas in the watering pattern of the sprinkler to keep the surrounding tree trunks dry. The unwatered areas can be easily varied in width and in depth. The V-shaped defector arm also reduces excess watering in the vicinity of the sprinkler since the water is deflected upwardly and outwardly rather than being merely deflected to one side or the other or being deflected downwardly. The angled V-shaped deflector arms also reduce splash and the resultant overwatering around the sprinkler as can occur when water impacts a flat surface normal to the water stream.

The sprinkler deflector to the invention is inexpensive to produce and is compact to be easy to ship. Therefore the cost to the user can be kept low, a very important consideration when considering the great number of sprinklers that are used in an orchard.

The sprinkler deflectors are easy to mount requiring the user to merely remove the existing sprinkler head and then mount one or more of the sprinkler deflectors between the sprinkler head and the riser via the mounting hole within the base of the sprinkler deflectors. No separate mounting hardware, which is easily lost, is needed; lock washers are also not needed because of the dimples provided around the mounting hole.

Other features and advantages of the present invention will appear from the following description in which the preferred embodiment is set forth in detail in conjunction with the accompanying drawings.

DETAILED DESCRIPTION OF THE PREFERRED EMBODIMENT

Figure 1:
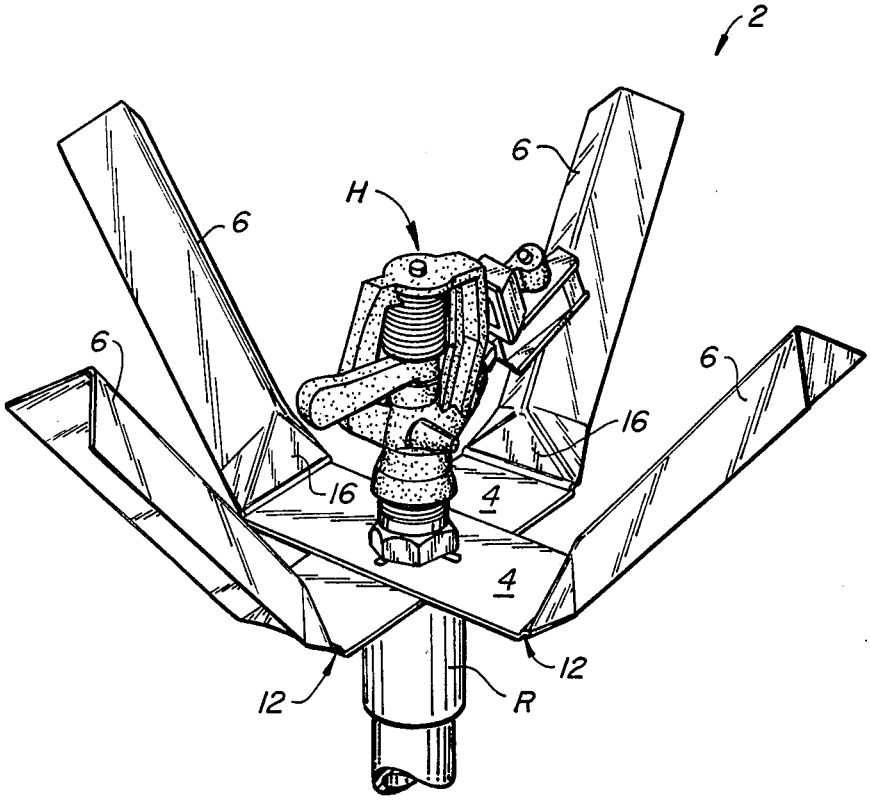
FIG. 1 is a perspective view showing two sprinkler deflectors of the present invention mounted between a sprinkler head and a riser.

Referring now to FIG. 1, a pair of sprinkler deflectors 2 are shown mounted between a sprinkler head H and a riser R. Broadly, sprinkler deflector 2 includes a horizontal base 4 and an upwardly and outwardly extending V-shaped deflector arms 6 extending from each end of elongate base 4. Base 4 and deflector arms 6 are preferably formed from a single elongate piece of bendable, deformable metal, such as aluminum or galvanized iron.

Figure 2:
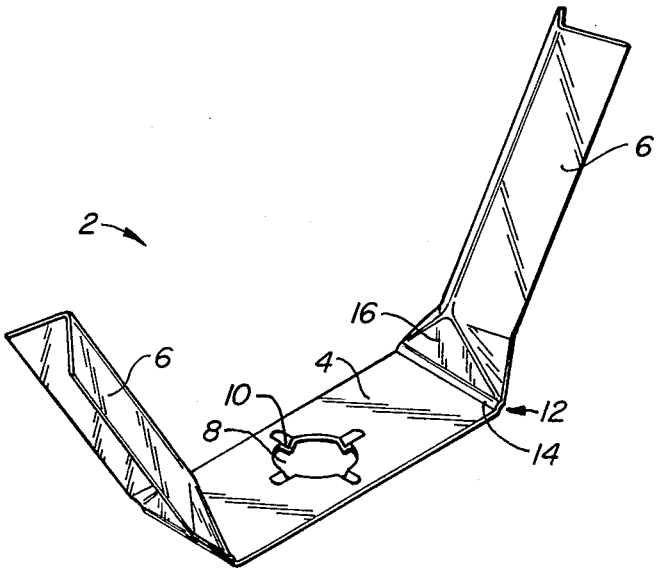
FIG. 2 is an isometric view of the sprinkler deflector of the present invention.

Base 4, as seen in FIG. 2, includes a mounting hole 8 formed centrally therein. A number of dimples 10 are formed in base 4 and act as a resilient spacer between sprinkler head H and riser R. This eliminates the need to use separate spacers or lock washers between base 4 and either riser R or sprinkler head H. Dimples 10 are equally spaced around hole 8 so that when two sprinkler deflectors 2 are used their perpendicular alignment is maintained by aligning the dimple depressions of the lower deflector with the protruding dimples of the upper deflector.

Figure 3:
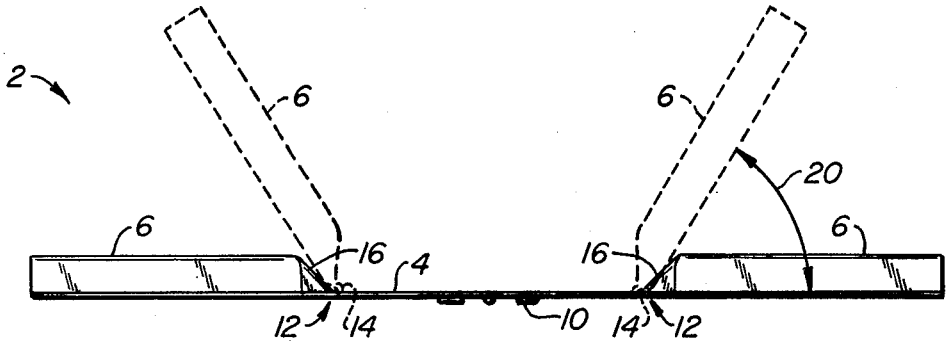
FIG. 3 is a side view of the sprinkler deflector of FIG. 2 shown in its flat shipping configuration.

A transition area 12 is formed at the intersection of base 4 and deflector arm 6 and includes an arcuate hinge area 14 and a generally triangular area 16. Since the sprinkler deflector 2 is designed to bend at arcuate hinge area 14, deflectors 2 can be left generally flat, as shown in FIG. 3, for shipment. This allows the sprinkler deflectors to be compactly and economically packed, stored and shipped to reduce the cost to the user.

Figure 4:
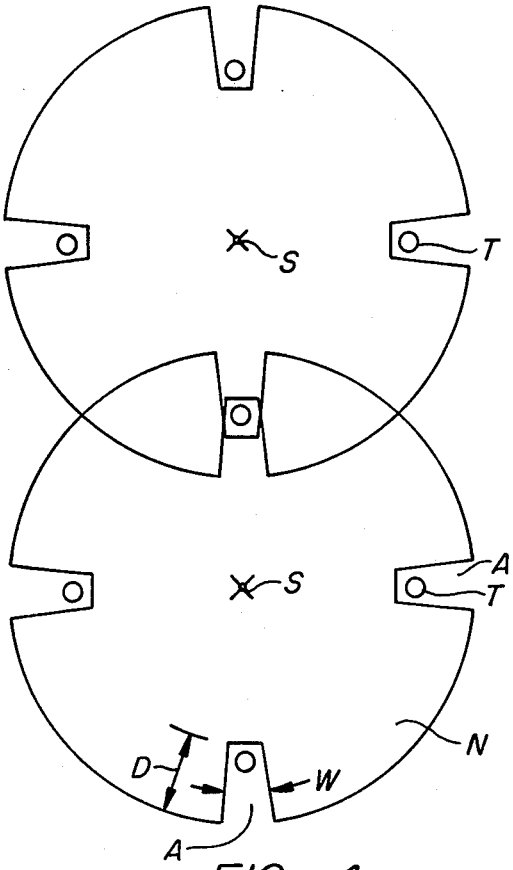
FIG. 4 is a schematic representation of a portion of an orchard showing the notched watered areas produced by the sprinkler deflectors of FIG. 2.

In use, a pair of sprinkler deflectors 2 are mounted between sprinkler heads H and riser R in an orchard. Arms 6 are bent to an appropriate angle 20 as shown in FIG. 3. A portion of a typical orchard is shown in FIG. 4 with the tree trunks T arranged in a rectangular pattern and sprinklers S located centrally between the trees. Ordinarily the two sprinkler deflectors 2 are mounted perpendicular to each other when trees T are arranged in a regular rectangular pattern as shown in FIG. 4. If necessary the upwardly and outwardly extending V-shaped deflector arms 6 can be bent somewhat to one side or the other so that the unwatered areas A are centered on trees T. Also, a sprinkler deflector 2 having only one V-shaped deflector arm 6 could be used to provide the necessary alignment with trees T. The arrangment shown in FIG. 1 produces the notched watered area pattern N of FIG. 4. The width W and depth D of each unwatered A is determined by the deformation of V-shaped deflector arm 6. Changing angle 20 of deflector arm 6 relative to base 4 changes both the depth D (corresponding to the minimum radius of the unwatered area) and the width W of areas A. Width W and depth D both increase as angle 20 increases. Although the width of the V-shaped deflector arms 6 could be changed to modify the width W of areas A, it has generally been found unnecessary to do so.

Modification and variation can be made to the disclosed embodiment without departing from the subject of the invention as defined in the following claims. For example, base 4 could be circular and have four equally spaced deflector arms 6 extending from its periphery. Also, it may be desired to have dimples formed in the base of some of the sprinkler deflectors but not in others when it is necessary that the deflectors be mounted at other than right angles to each other.

We claim:

1. A sprinkler deflector, for use with an impact-type sprinkler head mounted to a riser, comprising:

a deformable body including:

an elongate, generally horizontal flat base defining a central opening means for fixedly mounting said base between the sprinkler head and the riser;

a deformable deflector arm extending upwardly and outwardly at a deflector arm angle from said base, said deflector arm having upwardly and outwardly angled, generally V-shaped deflection surfaces; and transition means between said base and said deflector arm for allowing the angle of said deflector arm to be varied to vary the size of the unwatered area.

2. The sprinkler deflector of claim 1 further including a pair of deflector arms extending from opposite sides of said base.

3. The sprinkler deflector of claim 2 wherein said deflector arms extend from the ends of said elongate base.

4. The sprinkler deflector of claim 1 further comprising dimple means formed in said base adjacent said opening means for providing a resilient interface between the sprinkler head and the riser.

5. The sprinkler deflector of claim 4 wherein said dimple means is adapted to transversely align a pair of said sprinkler deflectors mounted between the sprinkler head and riser.

6. The sprinkler deflector of claim 1 wherein said base and deflector arm are a single unitary piece.

7. The sprinkler deflector of claim 1 further comprising spaced apart dimple means formed in the base near the circumference of said central opening means for providing a resilient interface between the sprinkler head and the riser.

* * * * *